US006190070B1

(12) United States Patent
Urban et al.

(10) Patent No.: US 6,190,070 B1
(45) Date of Patent: Feb. 20, 2001

(54) PRINTER WITH MEDIA CORRUGATION AT MEDIA OUTPUT

(75) Inventors: Carl T. Urban; David W. Hanks, both of Portland; Barry G. Mannie, Tualatin; Richard Brzezinski, Wilsonville, all of OR (US)

(73) Assignee: Xerox Corporation, Stamford, CT (US)

( * ) Notice: Under 35 U.S.C. 154(b), the term of this patent shall be extended for 0 days.

(21) Appl. No.: 09/170,922

(22) Filed: Oct. 13, 1998

(51) Int. Cl.[7] ..... B41J 13/03
(52) U.S. Cl. ..... 400/636.3; 400/636; 271/188
(58) Field of Search ..... 271/188, 314, 271/209, 272, 273; 400/636, 636.3, 637.3

(56) References Cited

U.S. PATENT DOCUMENTS

| | | | | |
|---|---|---|---|---|
| 3,545,371 | * | 12/1970 | Reist | 100/176 |
| 4,046,471 | | 9/1977 | Branham et al. | 355/14 |
| 4,214,740 | * | 7/1980 | Acquaviva | 271/3.2 |
| 4,234,180 | | 11/1980 | Looney | 271/3.1 |
| 4,272,181 | | 6/1981 | Treseder | 355/14 |
| 4,334,765 | | 6/1982 | Clark | 355/14 |
| 4,348,101 | | 9/1982 | Schonfeld et al. | 355/14 |
| 4,453,841 | | 6/1984 | Bobick et al. | 400/126 |
| 4,475,128 | | 10/1984 | Koumura | 358/296 |
| 4,632,377 | * | 12/1986 | Browse | 271/9.08 |
| 4,879,571 | | 11/1989 | Plasscheart | 355/26 |
| 4,881,132 | | 11/1989 | Lajos | 358/296 |
| 4,964,627 | * | 10/1990 | Watts et al. | 271/188 |
| 5,389,958 | | 2/1995 | Bui et al. | 347/103 |
| 5,558,322 | * | 9/1996 | Nakatomi | 271/209 |
| 5,611,022 | * | 3/1997 | Estrada et al. | 395/109 |
| 5,635,964 | | 6/1997 | Burr et al. | 347/17 |
| 5,764,245 | | 6/1998 | Yokoi | 347/16 |
| 5,764,263 | | 6/1998 | Lin | 347/101 |
| 5,772,343 | | 6/1998 | Beretta et al. | 400/624 |
| 5,790,766 | | 8/1998 | Sakamoto et al. | 395/113 |
| 5,808,645 | | 9/1998 | Reeves et al. | 347/103 |
| 5,820,284 | * | 10/1998 | Owada et al. | 400/662 |
| 5,852,764 | | 12/1998 | Kida et al. | 399/401 |

FOREIGN PATENT DOCUMENTS

| | | | |
|---|---|---|---|
| 63-74865 | * | 4/1988 | (JP) . |
| 9-015824 | * | 1/1997 | (JP) . |

OTHER PUBLICATIONS

Patent Application, Replaceable Intermediate Transfer Surface Application Assembly, SN 08/961,813, 24 pages.

* cited by examiner

*Primary Examiner*—Daniel J. Colilla
(74) *Attorney, Agent, or Firm*—Francis I. Gray

(57) ABSTRACT

A printer for generating an image on a media sheet has a printer body with a media path extending from a media supply in a downstream direction to a media exit. An output tray and a media ejection mechanism are connected to the printer body adjacent the media exit. The ejection mechanism has a number of drive roller pairs, each of which includes a first roller and a second roller contacting each other at a nip defining a nip plane. The first rollers of the respective roller pairs are coaxial with each other, and the second rollers of the respective roller pairs are coaxial with each other. The nips of the drive roller pairs occupy a common plane, and the drive roller pairs are spaced apart from each other to define a gap. The ejection mechanism includes at least one corrugation roller positioned in the gap, rotatable on a corrugation roller axis, and having a curved surface portion displaced from the nip plane.

14 Claims, 11 Drawing Sheets

FIG. 4
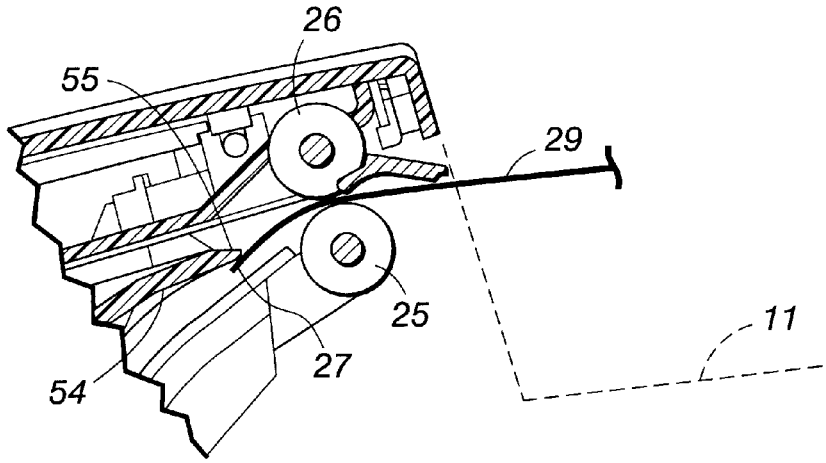
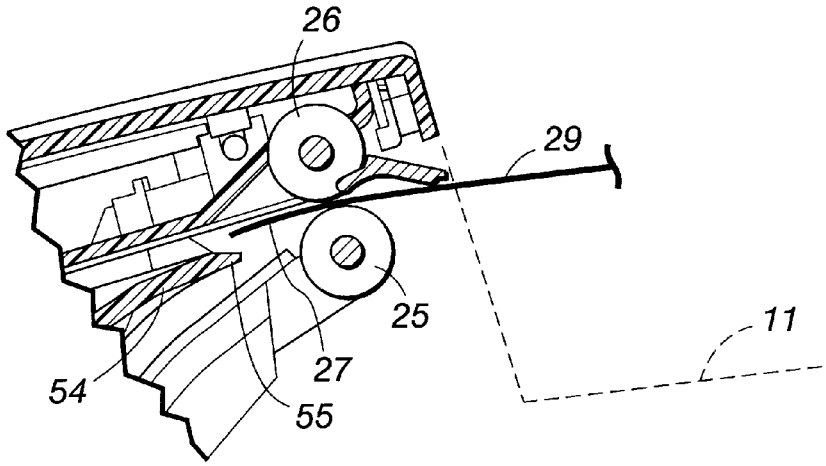
FIG. 5

FIG. 11A
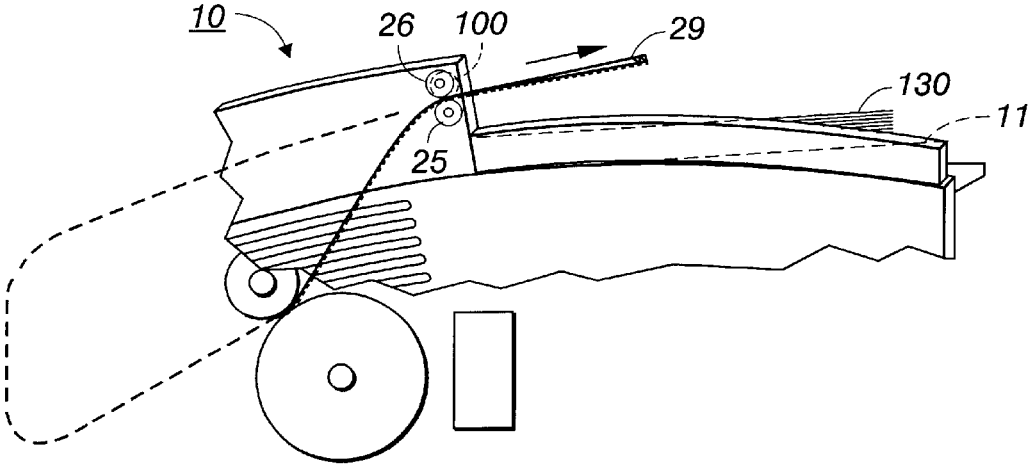
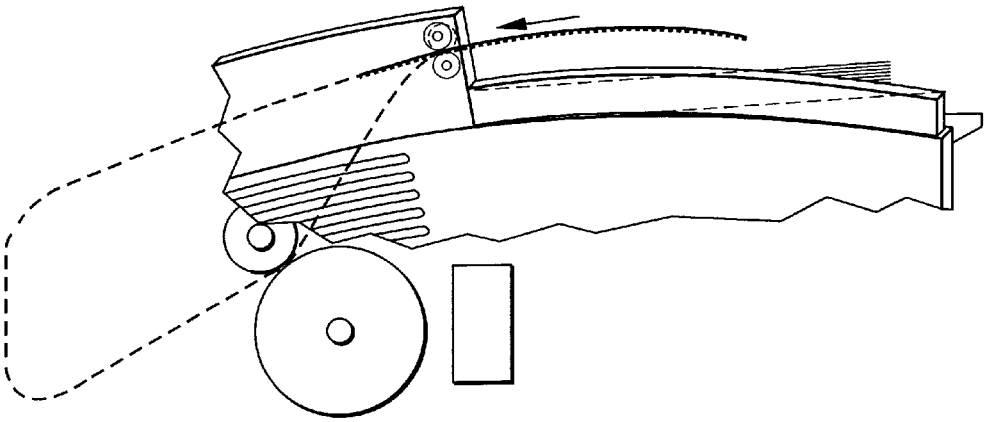
FIG. 11B

FIG. 11C
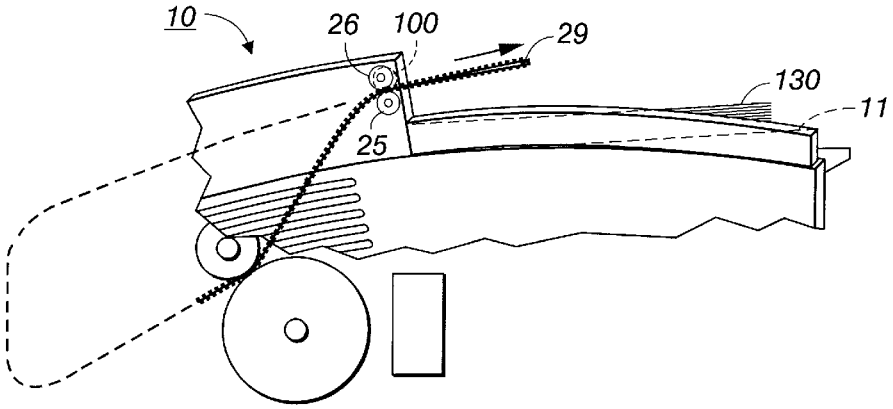
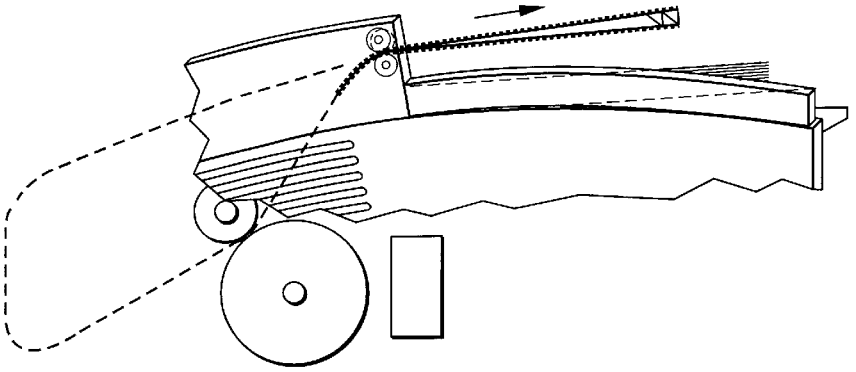
FIG. 11D
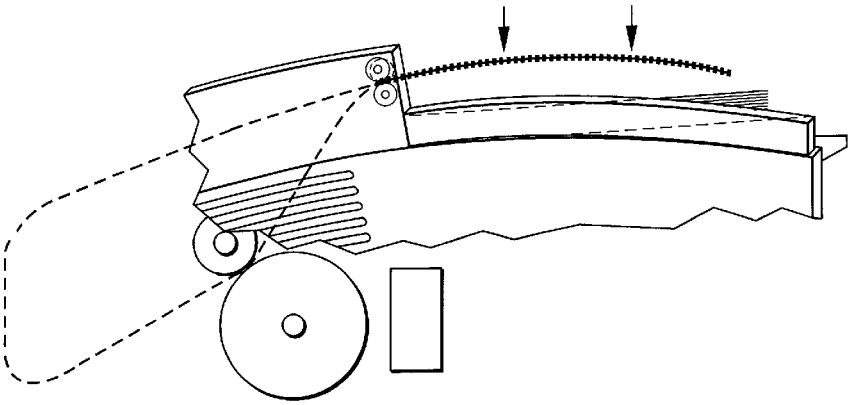
FIG. 11E

PRINTER WITH MEDIA CORRUGATION AT MEDIA OUTPUT

BACKGROUND AND SUMMARY OF THE INVENTION

This invention relates generally to a method and a system for handling media in a printer system, and more particularly, to deposition of media in an output tray without disrupting a stack of media sheets previously deposited in the tray.

Printers generally operate by serially drawing media sheets from a media supply, moving each sheet along a media path during which an image is formed on the sheet, and depositing the sheet on an output stack in an output tray. As printing proceeds, the supply is diminished, and the output stack increases. It is desirable to maintain a neat output stack that remains in the tray for ready removal by a user, and which preserves the order of printing. However, printers are susceptible to disruptions in the output stack caused by interaction of ejected sheets with those sheets already on the stack.

Typically, with a generally horizontal output tray, the printer's media exit is positioned a moderate height above the bottom of the tray to allow it to remain at a level adequately above a growing stack of media in the tray. However, this height causes an exit sheet ejected into an empty or nearly empty tray to curl downward under its own weight as it is ejected from the printer exit. Consequently, the leading edge of the exiting sheet strikes a middle portion of the prior sheet, and is scraped across the prior sheet as the exiting sheet is further ejected. This often causes the prior sheet to be slightly or moderately displaced from the stack, and the accumulation of such displacements during a long print job may lead to some sheets being spilled from the output tray. In addition, the scraping action of the exiting sheet's leading edge may damage a printed image, either when the image is formed of a malleable, ductile solid ink, or formed of a still-wet liquid ink.

Printers have addressed this issue by providing paper stops at the far edge of the media output tray away from the printer media exit. However, these add to complexity and cost, have undesirable aesthetics, and require adjustment for different media sizes. Other printers have employed media-stiffening mechanisms at the media exit that bend or crimp the media upon exit to cause it to eject without substantial downward curvature. However, these have proven unsuitable for printing solid ink images and for duplex (double-sided) printing, because they aggressively contact the sheet, and would damage such printed images. Accordingly, there is a need for a printer that overcomes these disadvantages.

The present invention overcomes these disadvantages by providing a printer for generating an image on a media sheet which has a printer body with a media path extending from a media supply in a downstream direction to a media exit. An output tray and a media ejection mechanism are connected to the printer body adjacent the media exit. The ejection mechanism has a number of drive roller pairs, each of which includes a first roller and a second roller contacting each other at a nip defining a nip plane. The first rollers of the respective roller pairs are coaxial with each other, and the second rollers of the respective roller pairs are coaxial with each other. The nips of the drive roller pairs occupy a common plane, and the drive roller pairs are spaced apart from each other to define a gap. The ejection mechanism includes at least one corrugation roller positioned in the gap, rotatable on a corrugation roller axis, and having a curved surface portion displaced from the nip plane.

BRIEF DESCRIPTION OF THE DRAWINGS

These and other aspects, features and advantages of the invention are apparent upon consideration of the following detailed disclosure of the invention, especially when it is taken in conjunction with the accompanying drawings wherein:

FIG. 4 is an enlarged partial side sectional view of the passive media path diverter and reversible exit rollers diagrammatically illustrating a simplex or single side imaged media about to partially exit the printer and reverse its path of travel into the duplex media imaging path;

FIG. 5 is an enlarged partial side sectional view of the passive media path diverter and exit roller apparatus of FIG. 3 showing the media reversing its path of direction and having used the stiffness of the media and entrance angle of the duplex path to snap the trail end above the passive media path diverter and commence its travel along the duplex media printing path;

FIGS. 11A–11E illustrate a sequence of operation of the printer of FIG. 1.

DETAILED DESCRIPTION OF THE PREFERRED EMBODIMENT

Figure 1:
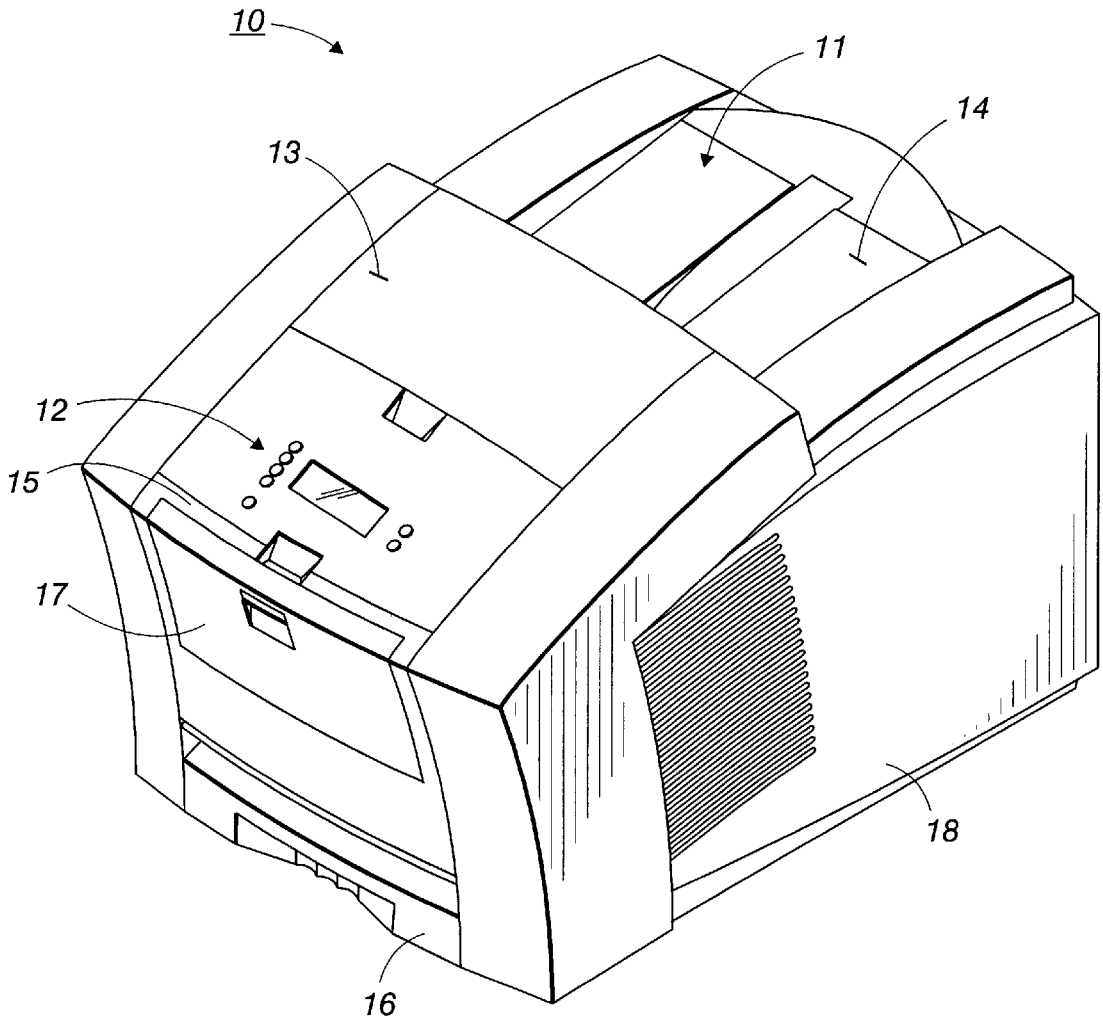
FIG. 1 is a front perspective view of the desktop printer utilizing the present invention.

FIG. 1 shows a desktop printer indicated generally by the numeral 10 which has a media output area 11 for receiving and holding a plurality of completed image output. An operator front panel permitting the operator to select certain operating features and to obtain feedback information as indicated generally by the numeral 12 mounted on an ink loader access cover 14 which permits replenishment of solid ink sticks while the printer is operating. A media path access cover 15 is hingedly affixed to the front of the printer 10 to permit access to the paper path and viewing of the media handling apparatus while a hand feed access door 17 is lowerable from cover 15 to permit hand feeding of selected media. A removable media tray 16 is positioned beneath the access cover 15 to provide the desired media for imaging by the printer. Side 18 of the printer is shown having air vents to permit air circulation to flow through the printer.

Figure 2:
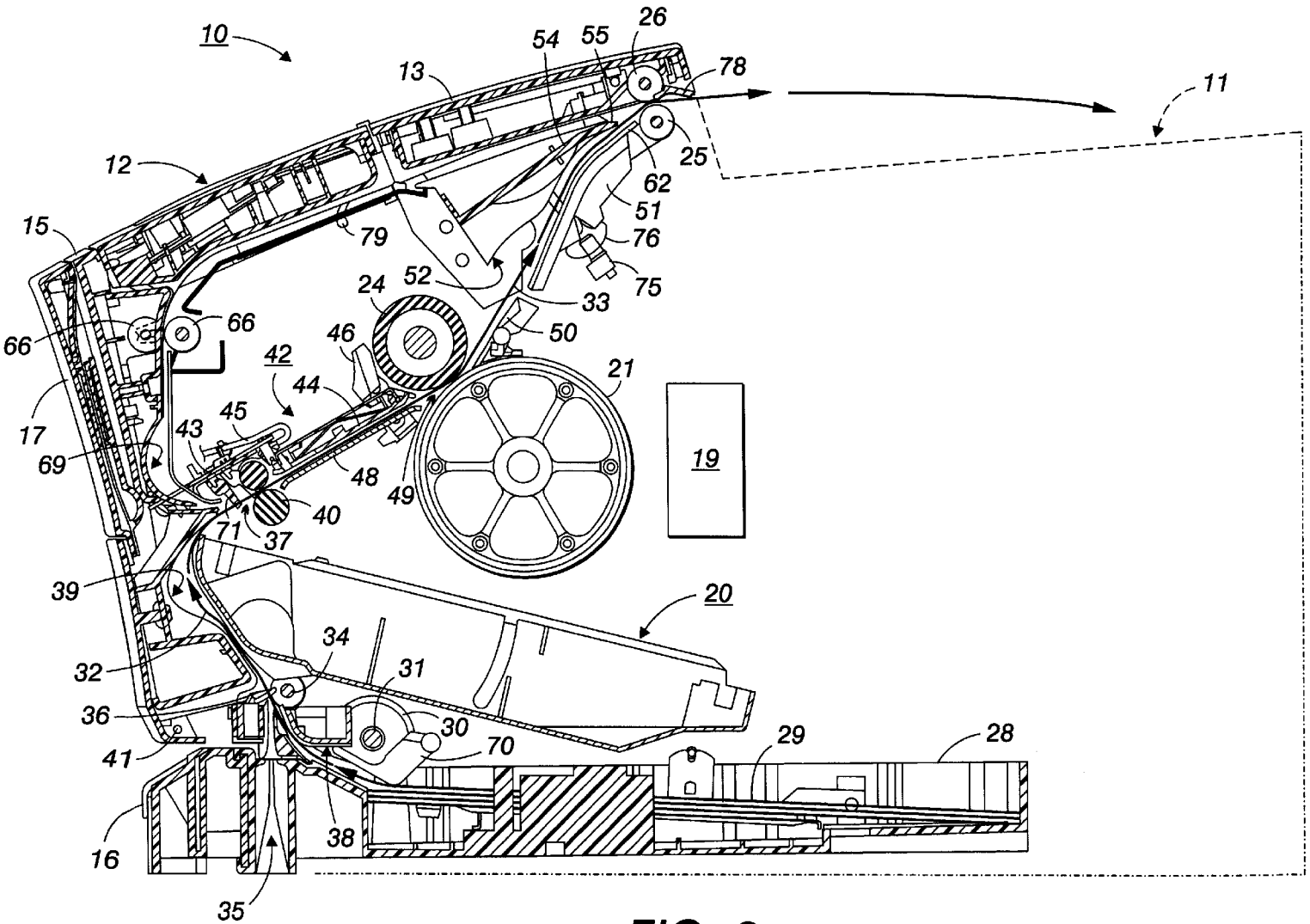
FIG. 2 is a partial side sectional view of the media handling apparatus of the desktop printer of FIG. 1 diagrammatically illustrating a portion of the printer and the media output receiving area.

Looking now at FIG. 2, there are shown in an enlarged partial side sectional view the operative parts of the printer 10 which are employed in transporting and imaging a media sheet as it passes through the printer. Diagrammatically illustrated is the media output area 11 and print head 19. Print head 19 applies molten phase change colored ink to a liquid intermediate transfer surface that is applied by an appropriate contact surface, such as a wick or web (not shown) contained within a drum maintenance unit, indicated generally by the numeral 20, to the arcuate support surface of a rotatable support drum 21. The image present on the liquid intermediate transfer layer on drum 21 is contact transferred to the media sheet 29 and then fused by the combination of heat and pressure applied between drum 21 and transfer and fusing roller 24 to complete the offset or indirect imaging process prior to the imaged media sheet 29 passing through the exit rollers 25 and 26, only one of each of which are shown, into the media output area 11. The indirect printing process employed in the printer utilizing the present invention is described in greater detail in U.S. Pat. No. 5,389,958 entitled "Imaging Process", issued Feb. 14, 1995; the print head 19 utilized in the printer employing the present invention is representative of that described in greater detail in U.S. Pat. No. 5,635,964 entitled "Ink-Jet Print Head Having Improved Thermal Uniformity", issued Jun. 3, 1997; and the drum maintenance unit 20 is described in further detail in U.S. Pat. No. 5,808,645 entitled "Removable Applicator Assembly For Applying A Liquid Layer", issued Sep. 15, 1998; and co-pending application Ser. No. 08/961,813, now U.S. Pat. No. 6,068,372, entitled "Replaceable Transfer Surface Assembly", filed Oct. 31, 1997, all assigned to the assignee of the present invention which are hereby specifically incorporated by reference in pertinent part.

Figure 3:
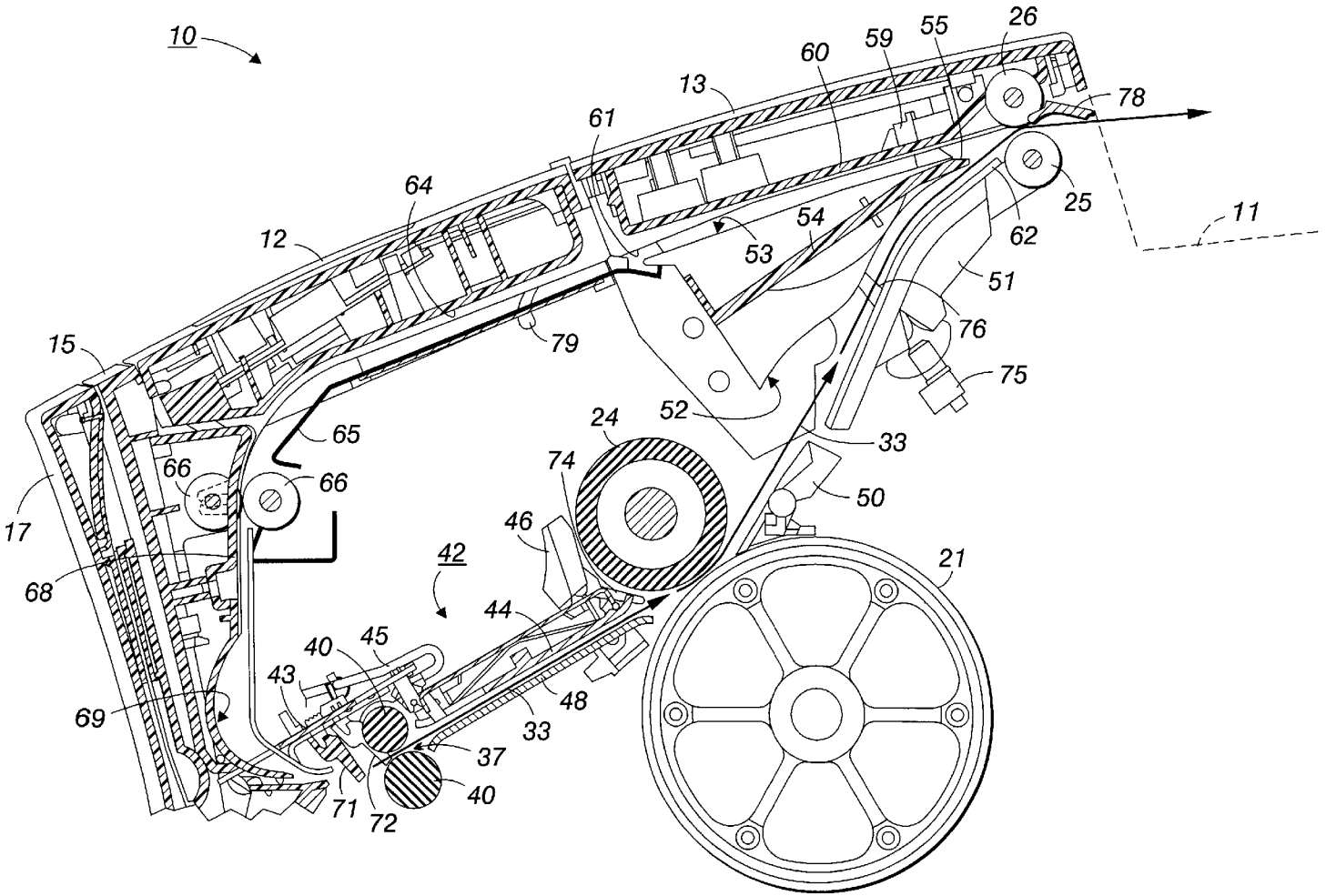
FIG. 3 is an enlarged partial sectional view of a portion of the simplex media printing path followed in the media handling apparatus of FIG. 2.

FIGS. 2 and 3 show individual sheets of print media 29 contained in the media supply tray receptacle 28 and a print media pick function that employs a pick roller 30 which picks a single sheet 29 of print medium from the media supply tray receptacle 28 by a single rotation of the shaft 31 which can be driven by any appropriate means, such as a flapper solenoid (not shown). The print media sheet 29 is drawn along a first simplex paper path, indicated by the arrow 32, by lower transport rollers 34, only one of which is shown in FIG. 2.

FIG. 2 also shows a media auxiliary tray feed chute 35 that delivers sheets of media from an auxiliary tray (not shown) which optionally can be utilized beneath printer 10. Feed chute 35 delivers the print media into the simplex media path 32 via appropriate paper pick and transport means and into contact with the lower transport rollers 34. A media guide and idler roller support 36 is shown cooperative with the one illustrated lower transport roller 34 to help guide media along path 32. Media sheets 29 coming out of media supply tray receptacle 28 also are guided along their path by the media guide surface 38 located intermediate the pick roller 30 and the lower transport roller 34. As the media sheets 29 are driven and guided through the simplex media path 32, they pass through a simplex buckle deskew area 39 that permits the individual media sheets 29 to align themselves correctly prior to passing into the nip, indicated generally by the numeral 37, formed by the upper transport rollers 40. A series of flexible guide fingers (not shown) are employed in the simplex buckle deskew area 39, which is located in the hingedly mounted media path access cover 15 that pivots about door pin 41. Media sheets 29 continue progressing from the simplex media path 32 to the media path 33 common to both simplex and duplex printing through the upper transport rollers 40 into the media preheater assembly indicated generally by the numeral 42.

Figure 7:
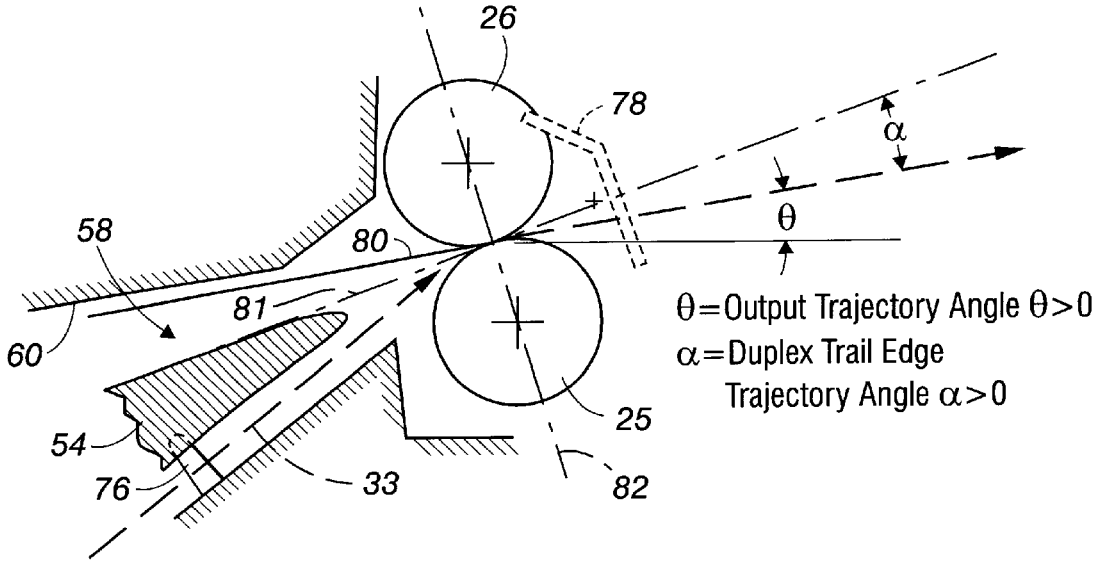
FIG. 7 is a diagrammatic illustration of the relationship of the positioning of the axes of the exit rollers and the tangent lines of the duplex media sheet path and of the top surface of the passive media path diverter.

Preheater assembly 42 includes a media preheater plate 44 that is made from electroless nickel plated aluminum and which is connected via an electrical connecting cable 45 to a circuit board 43 that controls the resistance heating elements used to heat the preheater plate 44 to the desired temperature. The media preheater assembly 42 also includes a preheater sensor body and bracket 46, partially shown. A preheater assembly media guide plate 48 underlies the media path and the heater plate 44 to support media sheets 29 passing thereover into the transfer and fixing nip 49 formed between the support drum 21 and the transfer and fusing roller 24, at which location the contact transfer to the media sheet 29 of the image applied by print head 19 to the liquid intermediate transfer layer on the surface of support drum 21 is accomplished. Following the contact transfer of the image, a stripper finger contact assembly 50 strips the media sheet 29 from the surface of drum 21 and continues to guide it upwardly onto the hinged media guide 51 with a plurality of guide ribs 62 (only one of which is shown) which underlie the media outer strip guide surfaces 52 (again only one of which is shown). The media sheet 29 continues passing upwardly beneath the stationary or passive media path diverter 54 into the exit rollers 25 and 26 whose axes, when connected by a straight line 82 as seen in FIG. 7, are offset from the vertical to facilitate both directing the trailing edge 27 of media sheet 29 back into the printer 10 above the tip 55 of passive media path diverter 54 and proper stacking of printed media sheets 29 in the output area 11. As seen in FIG. 7, the tangent line 80 for the duplex media path 58 is above the top surface of the passive media path diverter 54.

Figure 6:
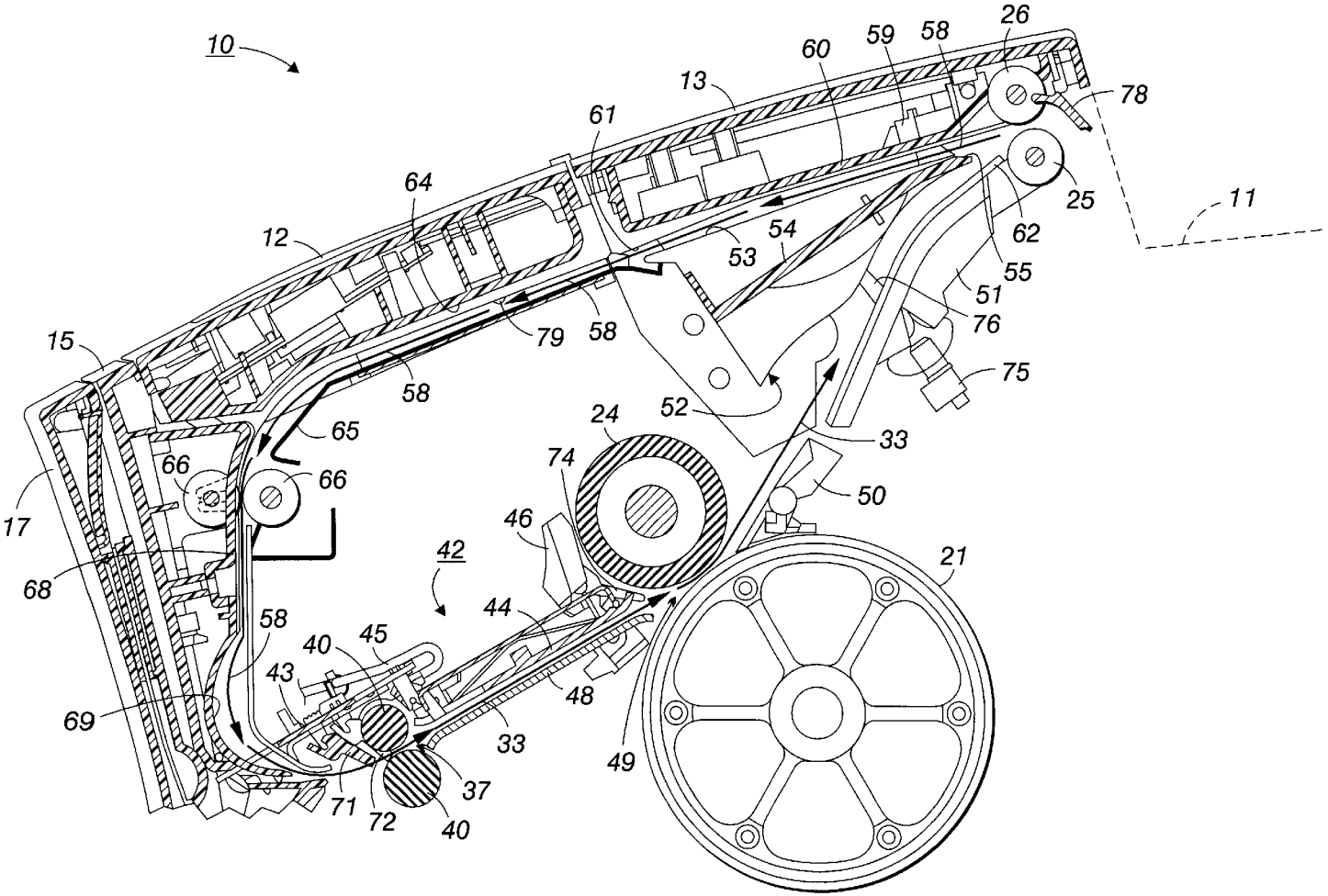
FIG. 6 is an enlarged partial side sectional view of the duplex media path of travel along the media handling apparatus of FIG. 2.

The media sheet 29 passes out between the exit rollers 25 and 26 in simplex printing all the way into the media output area 11. When duplex printing is selected, the printer controller (not shown) signals the printer to reverse the driven roller 25 when the media sheet 29 has progressed sufficiently passed the tip 55 of the passive media path diverter 54, as shown between FIGS. 4 and 5. FIG. 4 shows the media sheet 29 as it is just about to complete its forward progress into the output area 11 with the trailing edge 27 of media sheet 29 still retained just at the tip 55 of the passive media path diverter 54. FIG. 5 shows the trailing edge 27 having been advanced forwardly of the tip 55 of the passive media path diverter 54, so that the combination of the stiffness of the media and the positioning of the exit rollers 25 and 26 have combined to snap or raise the trailing edge 27 of the media sheet 29 above and beyond the passive media path diverter 54. Upon signal, the printer controller (not shown) reverses the direction of rotation of the driven exit roller 25 to draw the media sheet 29 back into the printer and into the duplex media path indicated by the arrow 58, best seen in FIG. 6. The media sheet 29 is partially exited from the printer 10 into a media output area 11 and then is drawn back into the printer along the duplex path of travel 58 that automatically reverses the media sheet 29 so that the trailing edge 27 of the media sheet 29 becomes the leading edge during the imaging of the second side of the media sheet 29.

Media sheet 29 is conveyed along duplex media path 58 by the exit rollers 25 and 26 which are biased by springs (not shown) retained in place on roller biasing supports 59 (only one of which is shown) within the assembly that includes upper media path access cover 13. The upper portion 53 of guide surface 52 and the duplex upper media guide 60 define the pathway between which media sheet 29 is passed along the duplex media path 58. Upper media guide 60 also has guide ribs 61 (only one of which is shown) and is a molded portion of the pivotable assembly that includes access cover 13. Plastic cover supports 62 supply support for the upper media guides 60 in the plastic molded cover 13. Similarly, the cover assembly with display 12 has plastic molded supporting structure 64 which acts as a media guide along the upper surface of duplex media path 58. A nickel plated steel plate 65 serves as a guide for the bottom portion of the duplex media path 58 beneath the cover assembly in which display 12 is found.

Once the media sheet 29 advances along duplex media path 58 to where its leading edge enters the nip formed by the duplex transport rollers 66, plastic molded guides 68 in access cover 15 direct the media sheet 29 into the duplex buckle deskew area 69. In combination with flexible guide fingers (not shown) and the upper transport rollers 40, media sheet 29 is buckled within the buckle deskew area 69 to permit the individual media sheets 29 to become properly aligned and then proceed through upper transport rollers 40 along the common media path 33 through the media preheater assembly 42 and through the transfer and fusing nip 49 previously described. The media sheet 29 receives the image applied from the print head 19 to the liquid intermediate transfer layer on the surface of support drum 21 and then is conveyed upwardly beneath the stationary or passive media path diverter 54 and out through the exit rollers 25 and 26 where the duplex imaged media sheet 29 is deposited in the media output area 11, best seen in FIG. 2.

A series of sensors track the progress of media sheets 29 about the media paths 32, 33 and 58, depending upon the selected printing mode. All of the sensors provide feedback into the printer controller (not shown) to track the status of the media sheet 29 within the printer 10. Sensors employed at various locations throughout the paper paths 32, 33 and 58 are typically OJ series opto sensors available from Aleph International of San Fernando, Calif., which utilize a pivotable sensing flag within a sensing field established by the sensor. The initial flag encountered is the tray empty flag 70 seen in FIG. 2 that will indicate when the supply of media sheets 29 needs to be replenished. A pair of sensors adjacent the nip formed by the upper transport rollers 40 signal the arrival of the media at the nip and the size of the media sheet by the movement of left edge flag 71 and A-size media sheet detector flag 72, respectively. Once the media sheet 29 has exited the preheater assembly 42, its progress is noted by movement of the preheater exit flag 74. Continuing along the common media path 33, the opto sensor 75 with its stripper flag 76 indicates that the media sheet 29 has been successfully stripped from the transport and fusing roller 24 and continues along its path toward the exit rollers 25 and 26. Once the media sheet 29 passes through the nip between exit rollers 25 and 26, it hits the exit flag and full output tray sensor 78 which provides the dual purpose of monitoring the progress of the media sheet 29 through the exit rollers, as well as alerting the printer operator that the output area 11 is full of imaged media sheets and needs to be emptied, as appropriate. When duplex printing is employed, the media sheet 29 recommences its travel along duplex media path 58 and reenters the printer engaging duplex flag 79 in the display cover 13, best seen in FIGS. 2 and 3 in the lowered position, to indicate successful reentry of the media sheet 29 into the printer and progress along the duplex media path 58. Finally, the media sheet 29, after passing through the upper transport rollers 66, passes into and through the buckle deskew area 69 and reengages the left edge detector flag 71 to recommence its transport along the common media path 33 and retracking of its progress by sensor flags 72, 74, 76 and 78, and their related sensors, as previously described, until the duplexed image sheet is deposited into the output area 11.

Key to being able to duplex image a media sheet 29 in the solid ink printer 10 is the control of the temperature of the media sheet 29 and the various heating apparatus after the simplex imaging has occurred with the placement of molten ink on the liquid intermediate transfer layer on the surface of support drum 21 and its contact transfer in a malleable state to the media sheet 29 in the transfer and fusing nip 49. The transferred image continues to cool and harden into a ductile state on the one side of the image media sheet 29 and then media sheet 29 is recommenced along its duplex media path 58 by the reversing of the upper transport rollers 25 and 26. To avoid remelting or smudging the simplex imaged side of the media sheet 29, the temperature of the media preheater and the transfer and fusing drum 24 must be controlled so that the temperature is not elevated sufficiently high to remelt the hardened image on the first side of the media sheet 29. Prior phase change ink printers operated the preheat apparatus 42 and the transfer and fusing roller 24 such that the temperature was approximately 90° C. in this area. In the present invention, the preheat and fusing temperatures are kept below 70° C., preferably between about 55° C. and 65° C., and most preferably at about 60° C. This temperature range provides sufficient heat to elevate the temperature of the image receiving medium, transfer and fuse the malleable image from the liquid intermediate transfer layer on the surface of support drum 21 onto the media sheet 29 to have successful imaging both in simplex and duplex printing and still avoid remelting or smudging the first side or simplex imaged media sheet 29 during the duplex imaging step. The imaged first side of the media sheet is not affected during the duplex imaging step.

In operation, the printer 10 has the pick roller 30 pick a media sheet 29 from the media supply tray receptacle 28 in the removable media tray 16 and start along the media path 32 by directing the sheet 29 into the lower transport rollers 34. Transport rollers 34 continue guiding the sheet forward along simplex media path 32 into the simplex buckle deskew area 39 where the media sheet 29, in cooperation with media guide fingers (not shown), is aligned prior to entry into the nip form by the upper transport rollers 40. The fingers both guide and provide a spring force unaffected by humidity that presses the lead edge into the stalled rollers, thus aligning the single media sheet prior to printing. A left edge detector flag 71 and A-size media detector flag 72 sense the media sheet 29 as it enters the transport rollers 40.

The media preheater assembly 42 utilizes resistance heaters controlled by a circuit board 43 to heat the media between the preheater guide plate 48 and the heater plate 44 to the appropriate temperature so that the media sheet upon passing therethrough achieves a temperature which is approximately 60° C. Passing out of the media preheater assembly 42, the media sheet 29 actuates the preheater exit flag 74 to signal that the media sheet 29 is about to enter the transfer and fusing nip 49 where image transfer takes place from the liquid intermediate transfer layer on the surface of support drum 21 where the print head 19 has ejected the molten image that is now in a malleable state.

The simplex image media sheet 29 is stripped from the support drum 21 by the stripper finger contact assembly 50 and continues along the common media path 33 where stripper flag 76 detects successful exiting from the nip 49. The media sheet 29 continues to travel up to the upper transport rollers 25 and 26 where the sensor activated by exit flag 78 signals the printer controller that the media sheet 29 is exiting the exit rollers 25 and 26 into the media output area 11. If simplex printing is the selected imaging technique, the media sheet 29 is deposited into the media output area 11 along the path indicated generally by the arrows in FIG. 2.

Where duplex imaging is the technique that has been selected, the exit rollers 25 and 26 are stopped and the driven exit roller 25 is reversed to draw the simplex imaged media sheet 29 back into the printer along the duplex media path 58. The trailing edge 27 of the media sheet, prior to being drawn back into the printer 10, has passed beyond the tip 55 of passive media diverter 54 and, in combination with the stiffness of the media sheet and the positioning of the upper transport rollers 25 and 26, is snapped up above and beyond the tip 55 so that upon reversal of motion, the media sheet 29 follows the duplex media path 58. Upper transport rollers 25 and 26 direct the simplex imaged media sheet 29 along the duplex media path 58 between the duplex upper media guides 60, the supporting structure 64, and the plate 65 as it moves toward the duplex transport rollers 66. En route along the duplex media path 58 and prior to entering the duplex transport rollers 66, the duplex path sensor is signaled by movement of flag 79 to control movement of the media sheet 29 through the final stages of its movement back into the common media path 33.

Prior to entering the common media path 33, the duplex transport rollers 66 deliver the media sheet 29 into the duplex buckle deskew area which, similarly to the simplex buckle deskew area 39, aligns the media sheet 29 with the aid of the flexible guide fingers (not shown) prior to entry into the upper transport rollers 40. Again the left edge detector flag 71 and the A-size media detector flag 72 are activated as the media sheet passes through the upper transport rollers into the preheater assembly 42 where the simplex imaged media sheet 29 is heated to the temperature of approximately 60° C. so as to preheat the media, but not remelt or cause smudging of the simplex image.

The exit from the media preheater 42 is continued as described earlier along the common media path 33 and the imaging of the second side of the media sheet 29 in the duplex imaging process is accomplished in like manner as previously described. The then duplex imaged media sheet 29 is transported upwardly along common media path 33 into the exit rollers 25 and 26 and the duplex imaged sheet 29 is ejected from the printer 10 into the media output area 11.

DETAILS OF EJECTION MECHANISM

Figure 8:
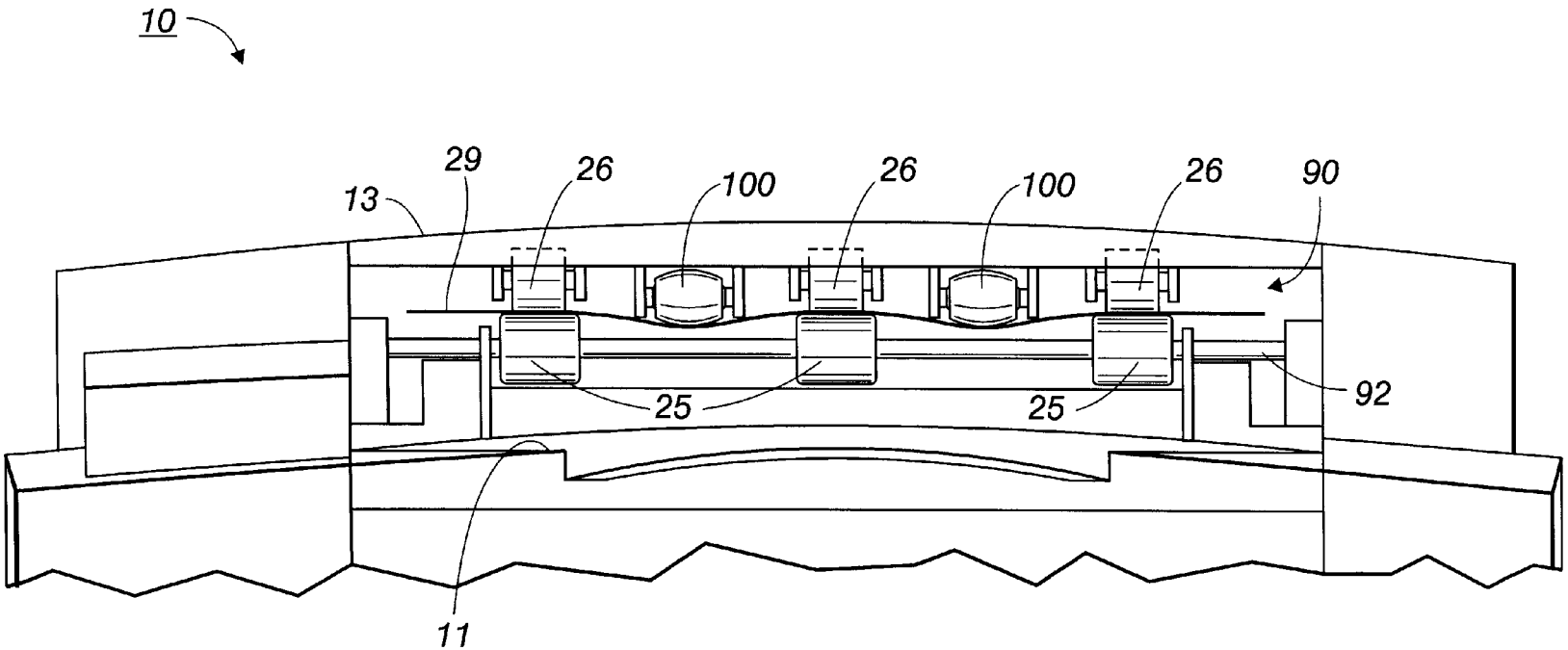
FIG. 8 is a partial end view of the printer of FIG. 1.

FIG. 8 shows the output or exit aperture 90 of the housing, viewed from across the output tray 11. As shown, the exit rollers 25 and 26 are arranged in three pairs, with end pairs spaced widely to grip the media sheet 29 near the edges of the sheet, and a central pair centered between the other two pairs. The lower or driven rollers 25 are mounted on a drive shaft 92, which is operably engaged to the printer's motorized media handling mechanisms. The upper rollers 26 are spring biased against the driven rollers 25 to define a nip that grips the media sheet 29, and are movable to accommodate various media thicknesses without excessive compression beyond the selected spring force. The exit rollers are resilient elastomeric material to avoid marring printed images that may exist on both sides of output from the illustrated duplexing printer. The exit rollers have cylindrical gripping surfaces, and the larger driven rollers are preferably chamfered at their edges to avoid generating creases or lines on the sheet due to forces discussed below.

Figure 9:
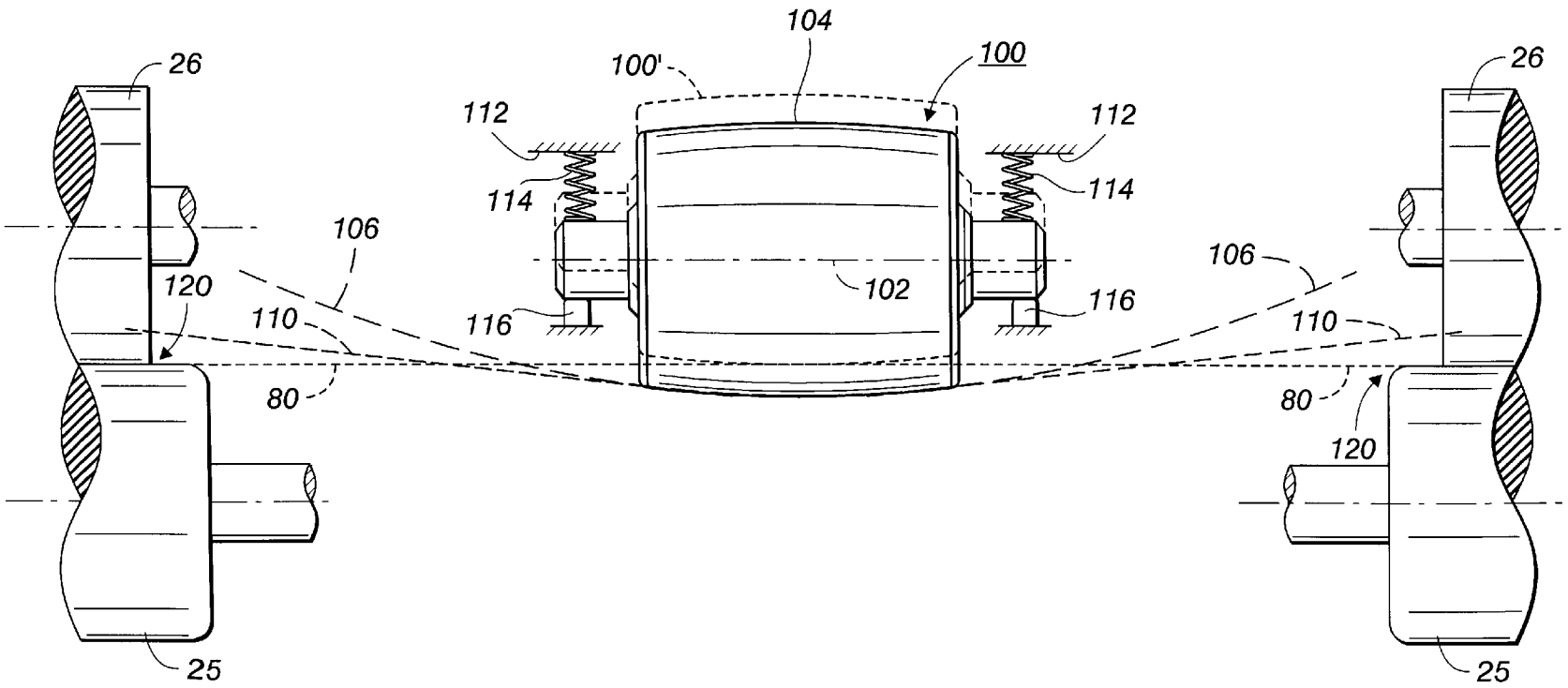
FIG. 9 is an enlarged view of a feed mechanism of the printer of FIG. 1.

Two tensioning or corrugation rollers 100 are positioned in alternating arrangement with the upper exit rollers 26, and rotate on corrugation roller axes 102 parallel to the axes of rollers 25 and 26, as shown in FIG. 9. Each roller 100 has a smooth barrel shaped surface 104 that is free of seams and other marks, and which has a arcuate curvature along its length defined by arc 106. Tangent lines 110 extend tangentially from the respective ends of the barrel surface 104, at the lower portion of each corrugation roller 100. When revolved about the roller axis 102, these lines define cones of tangency.

The corrugation roller is movably mounted to a printer frame portion 112 for vertical reciprocation against the biasing force of wire springs 114. Although shown schematically as compressed coil springs for clarity, wire springs mounted to the printer frame are employed in the preferred embodiment, as will be shown below. In the absence of media in the paper path or other force, the roller 100 is biased against stops 116 on the printer frame to the "home" position shown. When in the home position, the nips 120 defined between the adjacent pairs of exit rollers are below the roller arc 106, below the line of tangency 110, and thus outside of the volume of the cone of tangency defined by the line. This ensures that for all media thicknesses, the edges of the corrugation roller will not forcefully contact the sheet, which will extend between the nips of the adjacent roller pairs as shown in FIG. 8.

It is notable that for thicker and stiffer media, the movable exit rollers 26 will be pushed upward, moving the center of the nip line. However, the nip still remains outside of the cone of tangency because the roller 100 shifts upward comparably, prevent creasing of the sheet on the corrugation roller edges. When a stiff and thick sheet is used, the roller 100 shifts upward toward the shifted position 100', which may be above the nip plane 80 by the thickness of the media for rigid media. However, for most media, the roller remains in the range between the illustrated positions 100, 100'.

Figure 10:
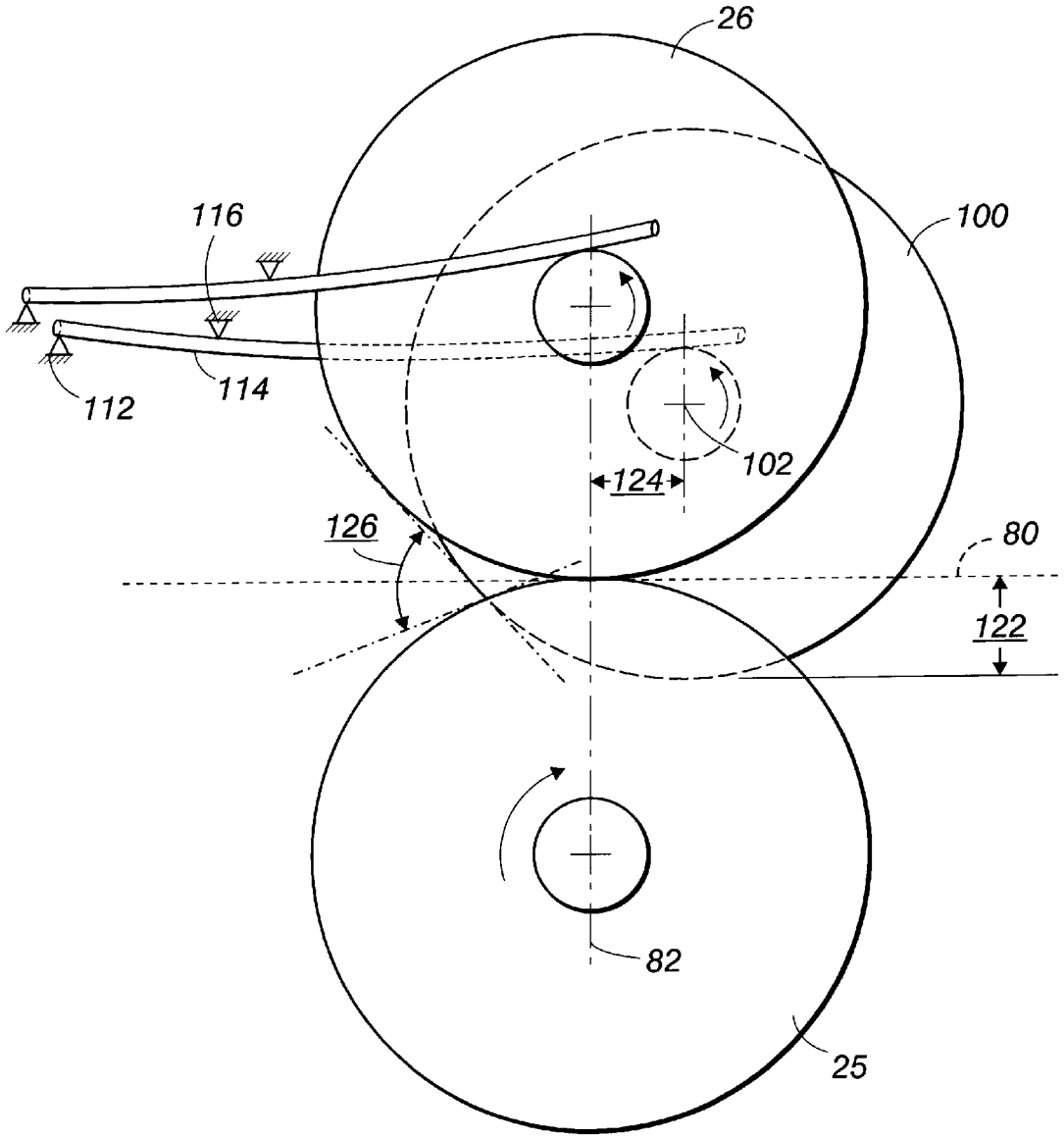
FIG. 10 is a simplified enlarged side view of the feed mechanism of the printer of FIG. 1.

FIG. 10 shows a side view of the exit roller mechanism, rotated slightly for clarity so that the nip plane 80 is horizontal in the illustration, although actually slightly offset with respect to the printer as shown in FIG. 7. The corrugation roller axis 102 is positioned to the right of, or in the downstream direction from, the plane 82 defined by the exit rollers. This ensures that media entering the nip from the left do not initially contact and abut the corrugation roller before being gripped by the exit rollers. In particular, for a given downward displacement 122 of the lower surface of the corrugation roller 100, there is needed a proportional lateral shift 124 in the downstream direction. In the preferred embodiment these shifts are approximately equal. With respect to the roller diameters, the shifts are about one-seventh of the roller diameter in either orthogonal direction, or slightly less than one-fourth of the roller diameter in the diagonal direction.

Another way of characterizing the geometrical relationship between the corrugation roller and the exit rollers is with respect to an intake angle 126 formed by the tangents to the surfaces of the driven rollers 25 and the corrugation roller at the point where they appear to intersect when viewed from the side as illustrated. If this angle is too great, either because of excessive downward offset 122 or inadequate lateral offset 124, or because of inadequate roller dimensions, a sheet approaching the nip may tend to abut the corrugation roller surface, and either never reach the exit roller nips, or be damaged as portions of the leading edge are pulled along while others are crushed against the rollers 100.

In the preferred embodiment, the springs are U-shaped wire springs that are mounted to the printer housing as schematically shown, with the free ends of each spring extending beyond the axles of each roller. Each corrugated roller is preloaded in their home position with 12 grams of force. The corrugation rollers 100 are formed of a rigid thermoplastic such as Delrin, with a maximum diameter of 0.620 inch, a barrel surface radius of 3.526 inch, and a barrel surface length of 0.750 inch. The exit rollers are formed of EPDM elastomer, and are spaced apart on a pitch of 3.25 inches. The driven rollers 25 are 0.750 inch in length and 0.631 in diameter, and the exit follower rollers 26 are 0.500 inch in length and of the same diameter.

As shown in FIGS. 11A–11E, duplex printing operation includes printing the first side of sheets 29, and feeding it out above the output tray 29 as shown in FIG. 11A. When the sheet is partially extended, as shown, it is straight and rigid, owing to the W-shaped corrugations formed by the rollers, which mechanically stiffen the sheet. For some media, extension beyond a selected point will lead to collapse of the corrugations. However, by this point, the extended portion is supported by a large air mass that limits the rate at which the sheet's free end drops downward. In addition, at the point of collapse, the leading edge of the sheet is approximately horizontal, so that further extension of the sheet tends to follow the plane of the leading edge, further limiting droop. With the high feed velocities employed (20 in/sec), a sheet may be fully ejected from the exit rollers before it first contacts the top sheet of a previously output stack 130.

For simplex printing, the ejected sheet floats downward atop the stack. As the output tray is tilted about 4° from the horizontal, back toward the media outlet, sheets tend to orient themselves neatly against the printer housing portion near the outlet. This avoids the tendency exhibited in other devices in which each exiting sheet drags against the prior sheet, inching each successive sheet away from the media outlet, and eventually causing sheets in the stack to extend beyond the edge of the tray and spill off the printer. The present invention avoids the need for a paper stop at the printer edge, and is suitable for different paper lengths without the need to readjust a stop.

For duplex printing, the sheet is nearly fully ejected so that its trailing edge can pass a diverter as discussed above, and become the leading edge for reentry into the printer for second side printing, as shown in FIG. 11B. In this instance, the sheet is normally supported by the corrugations for a sufficient portion of the extension above the output tray that after collapse of the corrugations, the sheet is fully extended and retracted so rapidly that the sheet never contacts the stack 130 of printed sheets.

As shown in FIG. 11C, the back side of the sheet is printed, and the now leading edge passes through the exit rollers and is corrugated by the corrugation rollers. In this instance, the corrugation rollers are making direct contact with a recently printed image. For the solid ink in the printer of the preferred embodiment, which are sensitive to marring, the corrugation roller geometry and smoothness is critical. As designed, the rollers 100 have a broad swath of contact that provides adequate corrugating force, but which has a very limited pressure on the image surface.

FIG. 11D illustrates the point at which the corrugations are no longer able to support the sheet, and collapse. Feeding continues until the sheet is fully ejected as shown in FIG. 11E. To provide a desired neat stack, without dragging of sheets across each other, and without shooting the sheets beyond the stack, the variables of feed velocity, and corrugation may be adjusted. Ideally, the corrugation displacement and spring force are limited so that it affects only the lighter weight sheets that are susceptible to exit feed problems, and limited only to the extent that the problems are just prevented. This avoids the need to throttle down the feed velocity, and avoids the visual artifacts that may be generated by excessively forceful handling of imaged sheets.

While the invention has been described above with references to specific embodiments thereof, it is apparent that many changes, modifications and variations in the materials, arrangements of parts and steps can be made without departing from the inventive concept disclosed herein. Accordingly, the spirit and broad scope of the appended claims is intended to embrace all such changes, modifications and variations that may occur to one of skill in the art upon a reading of the disclosure. All patent applications, patents and other publications cited herein are incorporated by reference in their entirety.

Having thus described the invention, what is claimed is:

1. A printer for generating an image on a media sheet comprising:

a printer body defining a media Path extending from a media supply in a downstream direction to a media exit defined in the body;

an output tray connected to the printer body adjacent the media exit;

a media ejection mechanism connected to the printer body adjacent the media exit;

the media ejection mechanism comprising a plurality of driver roller pairs;

each drive roller pair including a first roller and a second roller contacting each other at a nip defining a nip plane;

the first rollers of the respective roller pairs being coaxial with each other;

the second rollers of the respective roller pairs being coaxial with each other;

the nips of the drive roller pairs occupying a common plane;

the drive roller pairs being spaced apart from each other to define a gap; and the ejection mechanism including at least a barrel shaped corrugation roller positioned in the gap, rotatable on a corrugation roller axis that is not co-linear with the axes of the first and second rollers, and having a curved surface portion displaced from the nip plane, wherein the corrugation roller has a first radius of curvature of a first amount measured about its axis, and a greater second radius of curvature along its length.

2. The printer of claim 1 wherein the corrugation roller has a barrel shaped curved surface having opposed end portions, tangent lines extending from each end portion defining cones of tangency when revolved about an axis of the corrugation roller, the spacing between the drive rollers and the curvature and positional displacement of the corrugation roller being selected to position the nips of the drive roller pairs outside of the respective adjacent cones of tangency.

3. The printer of claim 1 wherein the corrugation roller has an axis of rotation positioned downstream of a drive roller plane including the axes of the drive rollers.

4. The printer of claim 1 wherein the corrugation roller curved surface portion displaced from the nip plane is tangent to a displacement plane parallel to and displaced from the nip plane.

5. The printer of claim 4 wherein the corrugation roller has an axis of rotation positioned downstream of a drive roller plane including the axes of the drive rollers, the down stream displacement being at least as great as the displacement of the corrugation roller curved surface portion displaced from the nip plane.

6. The printer of claim 1 including a printing mechanism in the printer body operable to generate a printed image on both sides of a media sheet.

7. The printer of claim 1 including a printing mechanism in the printer body operable to form a solid ink image on the media sheet.

8. The printer of claim 1 including three pairs of drive rollers, and two corrugation rollers interspersed among the drive roller pairs.

9. The printer of claim 1 wherein the corrugation rollers are movable, such that different thicknesses and stiffnesses of media may be accommodated.

10. A method of printing an image onto a media sheet with a printer defining a media path leading to an output tray, the method comprising the steps:

moving the sheet through the media path;

while moving the sheet, generating an image on the sheet, wherein generating an image on the sheet includes generating an image on both sides of the sheet;

after generating the image, feeding the sheet to the output tray, including gripping the sheet at spaced apart nips defining a common plane; and while gripping the sheet, deflecting intermediate portions of the sheet between the nips after gripping a leading edge of the sheet, including partly ejecting the sheet toward the output tray and deflecting intermediate portions of the sheet after generating an image on a first side of the sheet, then generating an image on the second side of the sheet, then transmitting the sheet to the output tray while deflecting the intermediate portions, such that the sheet is retained above the output tray between generating images on the first and second sides of the sheet.

11. The method of claim 10 including gripping the sheet at three positions and deflecting the sheet at two positions.

12. The method of claim 10 wherein deflecting the sheet includes biasing a barrel shaped roller against the sheet.

13. The method of claim 10 wherein generating an image on the sheet includes applying a solid, malleable ink to the sheet.

14. The method of claim 10 wherein deflecting the sheet portions includes contacting the sheet with a positively-curved three dimensional surface.

* * * * *